US006329639B1

(12) United States Patent
Akutsu et al.

(10) Patent No.: US 6,329,639 B1
(45) Date of Patent: Dec. 11, 2001

(54) HEAT GENERATING MEDIUM FOR TONER IMAGE FIXING AND A FIXING APPARATUS USING THE HEAT GENERATING MEDIUM

(75) Inventors: Eiichi Akutsu; Hiroshi Takayama; Shigehito Ando; Kenji Ogi; Yasuhiro Uehara, all of Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1409 days.

(21) Appl. No.: 08/700,578

(22) Filed: Aug. 14, 1996

Related U.S. Application Data

(63) Continuation of application No. 08/258,102, filed on Jun. 10, 1994, now abandoned.

(30) Foreign Application Priority Data

Jun. 11, 1993 (JP) ..... 5-140365

(51) Int. Cl.[7] ..... H05B 1/00
(52) U.S. Cl. ..... 219/216; 219/469; 219/549
(58) Field of Search ..... 219/216, 549, 219/469, 470; 355/285, 289, 290

(56) References Cited

U.S. PATENT DOCUMENTS 4,745,431 * 5/1988 Kogure et al. ..... 355/290
5,115,279 * 5/1992 Nishikawa et al. ..... 219/216
5,151,719 9/1992 Akutsu et al. .
5,349,423 * 9/1994 Nagato et al. ..... 355/285

FOREIGN PATENT DOCUMENTS 56-7236 2/1981 (JP) .
58-36337 8/1983 (JP) .
59-21557 5/1984 (JP) .
2-19879 1/1990 (JP) .
3-144676 6/1991 (JP) .
4-114184 4/1992 (JP) .

* cited by examiner

*Primary Examiner*—Samuel M. Heinrich
(74) *Attorney, Agent, or Firm*—Finnegan, Henderson, Farabow, Garrett & Dunner, L.L.P.

(57) ABSTRACT

A heat generating medium for image fixing includes a conductive support layer of good electrical and thermal conductivity, a low surface energy layer formed on one of the surfaces of the conductive support layer, and a heat generating layer formed on the other surface of the conductive support layer. A fixing apparatus is also disclosed, which includes the heat generating medium as described above, and a power supplying device for feeding current to the heat generating layer, wherein a recording sheet bearing a non-fixed toner image thereon is brought into press contact with the heat generating layer which generates heat when it receives current from the power supply device.

20 Claims, 5 Drawing Sheets

HEAT GENERATING MEDIUM FOR TONER IMAGE FIXING AND A FIXING APPARATUS USING THE HEAT GENERATING MEDIUM

This application is a continuation of application Ser. No. 08/258,102, filed Jun. 10, 1994, now abandoned.

BACKGROUND OF THE INVENTION

1. Field of the Invention

The present invention relates to a heat generating medium for toner image fixing, which is used for heating and fixing a toner image in an image forming apparatus, such as a copying machine or a printer, and a fixing apparatus using the heat generating medium.

2. Discussion of the Prior Art

A known heating/fixing apparatus for an image forming apparatus includes a heating roll, and a pressure roll coming in press contact with the heating roll. The heating roll is constructed such that the surface of a pipe-like metal roll is covered with fluoroplastics or silicon rubber, and a bar-like heater lamp is inserted into the hole longitudinally formed in the metal roll. Current is fed to the heater lamp which in turn radiates heat. The metal roll absorbs the radiant heat through the inner wall thereof, to increase temperature of the whole heating roll up to the temperature required for toner image fixing. A recording sheet bearing a non-fixed toner image recorded thereon is moved through a nip between the heating roll and the pressure roll. At this time, the non-fixed toner image undergoes heating and pressure to be fixed on the recording sheet. For the heating/fixing apparatus, reference is made to Japanese Patent Publication Nos. Sho. 59-21557, 58-36337, and 56-7236.

In the heating/fixing apparatus thus constructed, it is necessary to heat the whole metal heating roll up to the temperature required for toner image fixing, and to keep the roll at that temperature. For this reason, the fixing apparatus suffers from the following problems. The power consumption is large. A quantity of generated heat is large, increasing temperature within the apparatus. Much time is required for heating the metal heating roll up to the fixing temperature since the heating roll has a large heat capacity. It is difficult to strictly control toner temperature during the fixing process. This fact leads to deterioration of the image quality.

The inventors of the Present Patent Application proposed a unique image fixing apparatus in Published Unexamined Japanese Patent Application No. Hei. 4-114184. The image fixing apparatus includes heating means for heating a non-fixed image in a manner that it presses an image bearing means bearing a non-fixed image thereon from above, and control means which receives image signals from a record head for forming a non-fixed image, and controls the heating means so as to selectively heat only an area including the non-fixed image on a sheet in accordance with the image signals. The heating means, shaped like a belt or a rigid-drum, is composed of a layer for preventing color image forming material of a non-fixed image from sticking to the heating means, a conductive layer layered on the material sticking preventing layer, and a heating layer, layered on the conductive layer, for generating heat when it receives electric energy. The heating means presses the image bearing means bearing a non-fixed image thereon from above, and heat the non-fixed image. The image fixing apparatus succeeds to some extent in reducing the power consumption, realizing the quick start of the apparatus, increasing the fixing speed, checking the increase of the temperature within the apparatus, and the like.

In the proposed fixing apparatus, the image signals for fixing the non-fixed toner image are input to the heating means through the record head. The record head consists of a plural number of blocks longitudinally arrayed, and is supported so as to directly contact with the heating means in a sliding manner. In fixing the image, the blocks are selectively heated in accordance with image signals. In some friction conditions, all the longitudinally arrayed blocks are not always placed in a stable heating state. Since the heating means is thin, its transportation reliability is frequently poor, Particularly, in the case of the belt-like heat generating medium, the transportation reliability becomes problematic since a tensile strength thereof is small. The small tonsils strength also brings about poor contact of the heating means with the image bearing means and insufficient pressure.

The inventors intently and carefully made a study for developing an inventive and unique image fixing apparatus which is more compact, more reliably transported, and can solve the various problems of the conventional fixing apparatus, including undesirable power consumption, unstable, temperature within the apparatus, large heat capacity of the heating roll requiring start-up delay, and insufficient temperature control accompanied by deterioration of image quality.

SUMMARY OF THE INVENTION

Accordingly, an object of the present invention is to provide a heat generating medium for image fixing which is simple in construction, highly reliable in transportation, short in stand-by time, easy in temperature control, and applicable for various types of the fixing apparatus, and further consumes less power and checks temperature within the apparatus.

Another object of the present invention is to provide a fixing apparatus using such a heat generating medium, which is useful when it is used in electrophotographic copying machines, printers, facsimile machines, and the like.

To achieve the first object, there is provided a heat generating medium for image fixing comprising a conductive support layer of good thermal conduction, a low surface energy layer formed on one side of the conductive support layer, and a heat generating layer formed on the other side thereof.

To achieve the second object, there is provided a fixing apparatus comprising a heat generating medium for image fixing constructed as mentioned above, and a power supplying means for supplying electric power or current to the heat generating medium, wherein a recording sheet bearing a toner image not yet fixed is pressed against the heat generating medium which generates heat when receiving current from the power supplying means.

BRIEF DESCRIPTION OF THE DRAWINGS

The accompanying drawings, which are incorporated in and constitute a part of this specification, illustrate embodiments of the invention and, together with the description, serve to explain the objects, advantages and principles of the invention. In the drawings.

DETAILED DESCRIPTION OF THE PREFERRED EMBODIMENTS

Figure 1:
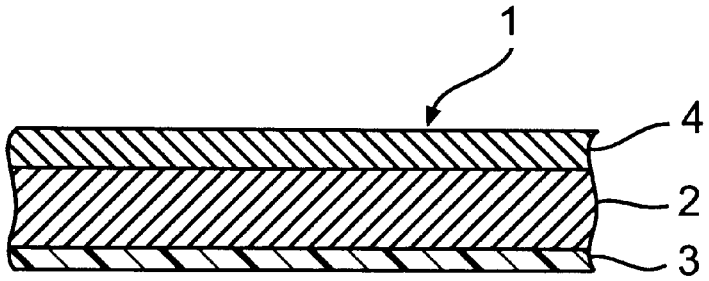
FIG. 1 is a cross sectional view showing an embodiment of a heat generating medium according to the present invention.
Figure 2:
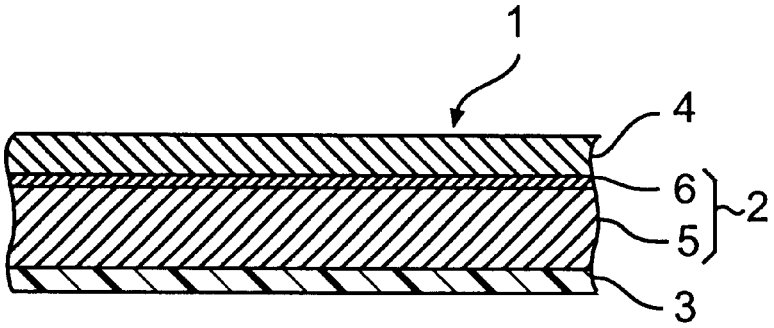
FIG. 2 is a cross sectional view showing another embodiment of a heat generating medium according to the present invention.
Figure 3:
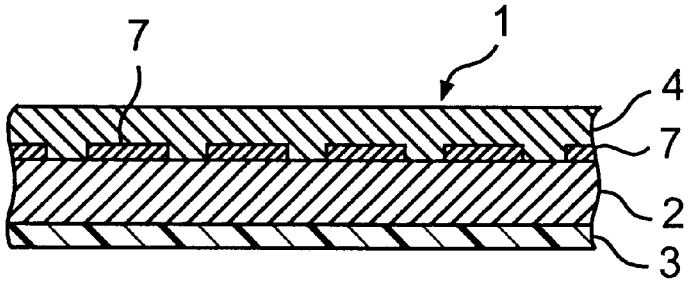
FIG. 3 is a cross sectional view showing yet another embodiment of a heat generating medium according to the present invention.

The preferred embodiments of the present invention will be described in details with reference to the accompanying drawings In the present invention, a heat generating medium 1, as shown in FIGS. 1 to 3, is composed mainly of a conductive support layer 2, a low surface energy layer 3, and a heat generating layer 4.

The heat generating medium 1 functions to hold the layers formed on both sides thereof and to assist the transportation of the layers, and serve as a return electrode for the current fed to the heat generating layer for the purpose of generating heat therein. The heat generating medium is made of conductive material of good thermal conduction since it must transfer the heat from the heat generating layer to the toner image not yet fixed, with little loss.

The conductive support layer 2 is a single layer structure made of metallic material (FIG. 1), or a multi-layer structure including a conductive support member 5 and a highly conductive thin film layer 6 (FIG. 2). Pattern electrodes 7 divided for isolation and patterned properly to have a pattern of stripes, for example (FIG. 3), are further formed on the surface of the conductive support layer 2 where it is brought into contact with the heat generating layer. In a case where the pattern electrodes 7 are used, the pattern electrodes preferentially function as the return electrodes to the portions of the support layer each being located between the adjacent return electrodes. Accordingly, the heat generating layer can be partially heated in connection with the pattern electrodes.

The metal may be any of iron, copper, zinc, gold, silver, nickel, aluminum, titanium, cobalt, tungsten, molybdenum, stainless steel and the like, or an alloy of these materials. The highly conductive thin film layer 6 is made of material of an excellent strength, for example, any of the metallic materials as mentioned above, or a composite material containing metal as a major component. The highly conductive thin film layer 6 is made of material having high electrical conductivity, and has a thickness of 10 $\mu$m or less, preferably 0.5 $\mu$m or less. The highly conductive thin film layer 6 is formed using a metallic material of which the electrical conductivity is higher than that of the conductive support member 5 or conductive ceramics by a sputtering method or a vacuum vapor deposition method. Alternatively, a conductive paste in these materials is screen printed. The pattern electrodes 7 having a thickness of 5 $\mu$m or less, preferably 1 $\mu$m or less, are made of the same material as that of the highly conductive thin film layer 6 by a photolithographic method or a screen print method.

The conductive support layer 2 has a conductivity of $10^3$ $\Omega\cdot$cm or less, preferably not more than $10^{-3}$ $\Omega\cdot$cm in volume resistance. When it has a volume resistance greater than or equal to $10^3$ $\Omega\cdot$cm, it sometimes does not fully operate as a return electrode for the heat generating layer. As examples of materials, nickel has $7\times10^{-6}$ $\Omega\cdot$cm, and SUS has $7\times10^{-5}$ $\Omega\cdot$cm.

When the conductive support layer is shaped like a belt, the thickness of the conductive support layer is 3 to 200 $\mu$m, preferably 7 to 70 $\mu$m. When it is tubular in shape, its thickness is 10 $\mu$m to 1 mm, preferably 15 to 120 $\mu$m. If the thickness of the conductive support layer is below the lower limit value, the tensile strength of the heat generating layer is unsatisfactory. Under this condition, a necessary support function or a required transport reliability cannot be secured. On the other hand, if the thickness thereof exceeds the upper limit value, its thermal conductivity is poor or energy consumption is large.

The tensile strength of the conductive support layer 2 is greater than or equal to 10 kg/mm$^2$, preferably 20 kg/mm$^2$ to 100 kg/mm$^2$ in order to operate as a heat generating layer having sufficient strength. As example of material of a conductive support layer, nickel has a minimum strenght of about 34 kg/mm$^2$, SUS a minimum strenght of about 55 kg/mm$^2$, the tensile strength of insulating films used as a conventional fixing medium, are considerably lower polyimide film has about 17 kg/mm$^2$, carbonblack-dispersing-polycarbonate film has a strenght of about 7 kg/mm$^2$, carbonblack-dispersing-polyimide film has a strenght of about 10 kg/mm$^2$. When the tensile strength is less than 100 kg/mm$^2$, there may occur deformation or extension under condition of high-temperature/high-pressure.

Since the heat generated by applying electrical power to the heat generating layer is transported to the low surface energy layer (fixing surface) through the conductive support layer 2, the conductive support layer 2 is preferably made of a material which has a high thermal conductivity. $6\times10^{-2}$ cal$\cdot$cm$^{-1}\cdot$deg. When the thermal conductivity is than $6\times10^{-2}$ cal$\cdot$cm$^{-1}\cdot$sec$^{-1}\cdot$deg$^{-1}$, it sometimes takes time to reach the required temperature, or it is sometimes necessary to apply extra electrical power. Specific having a thermal conductivity of 0.1 to 0.15, aluminum 0.487, copper 0.923 (cal$\cdot$cm$^{-1}\cdot$sec$^{-1}\cdot$deg$^{-1}$). Comparatively, $SiO_2$ has a thermal conductivity of $3\times10^{-3}$, carbon has a thermal conductivity of $8.5\times10^{-3}$, polyimide has a thermal conductivity of $3.7\times10^{-4}$ (cal$\cdot$cm$^{-1}\cdot$sec$^{-1}\cdot$deg$^{-1}$).

In addition, the fixing medium has a structure such that a portion of the energy surface layer or a heat generating layer is removed to expose the a conductive support layer. The exposed area operates as a return electrode which mediates current pathway between an electrode receiving current and a provided electrode due to being always slided with a grounded electrode (not shown). Clearly from the foregoing view, the current path for generating heat in the fixing medium of the present invention passes a contact electrode (power supplying means)→heat generating layer→return electrode→ground electrode, and the heat of the fixing medium is generated at a heat generating layer between a power supplying means and a return electrode.

The low surface energy layer 3, which comes in contact with a non-fixed toner image in the fixing process, functions to prevent the toner image from sticking to the low surface energy layer itself, and to protect the underlayer thereof. For This reason, the material of the layer 3 has a heat resistance of at least 130° C. The critical surface tension is not more than 32 dyne/cm, preferably not more than 22 dyne/cm. If the critical surface tension is in excess of 32 dyne/cm, part of the toner of the non-fixed toner image sticks to the layer 3, soiling the surface of the heat generating layer.

The material suitable for the low surface energy layer is any of fluorine plastics, fluorinated ethylene propylene (FEP), dimethyl polysiloxane resin, silicone rubber, and the like, or a composite material containing any of these materials and conductive powder. Where such a composite material is used, an electric resistance of the low surface energy layer may be controlled to prevent it from being electrically charged. The surface of this layer may be coated with anti-toner-adhesion agent, for example, silicon oil, or lubricant, in order to improve the toner offset prevention effect.

The thickness of the low surface energy layer is 20 $\mu$m or less, preferably 0.2 to 5 $\mu$m. Where the low surface energy layer is in excess of 20 $\mu$m, the distance from the heat generating layer to the object to be heated is long, so that the heat transfer loss is increased and the energy efficiency is reduced.

The heat generating layer 4 generates Joule heat when it receives current fed thereto. The heat resistance of the heat generating layer is 200° C. or higher, preferably 300° C. or higher. The volume resistance thereof is within a range from $10^{-3}$ to $10^{7}$ Ω·cm, preferably $10^{-1}$ to $10^{1}$ Ω·cm.

The material for the heat generating layer is formed by mixing or chemically combining one or more conductive materials, such as conductive ceramics, conductive carbon, and metal, with one or more insulating materials, such as insulating ceramics and heat resistive resin.

The thickness of the heat generating layer is within 20 $\mu$m, preferably within a range of 1 to 5 $\mu$m. Where the thickness of the layer is in excess of 20 $\mu$m, a quantity of generated heat per input power is reduced, consuming much energy.

Figure 4:
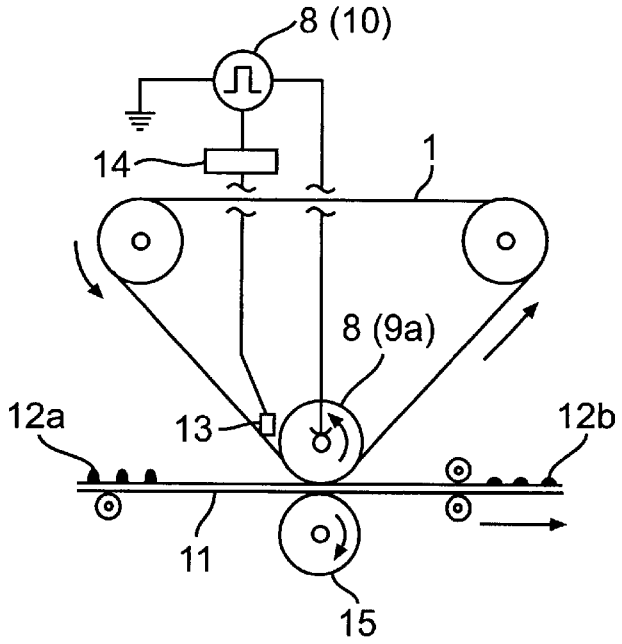
FIG. 4 is a schematic diagram showing an embodiment of a fixing apparatus using a belt-like heat generating medium according to the present invention.
Figure 5:
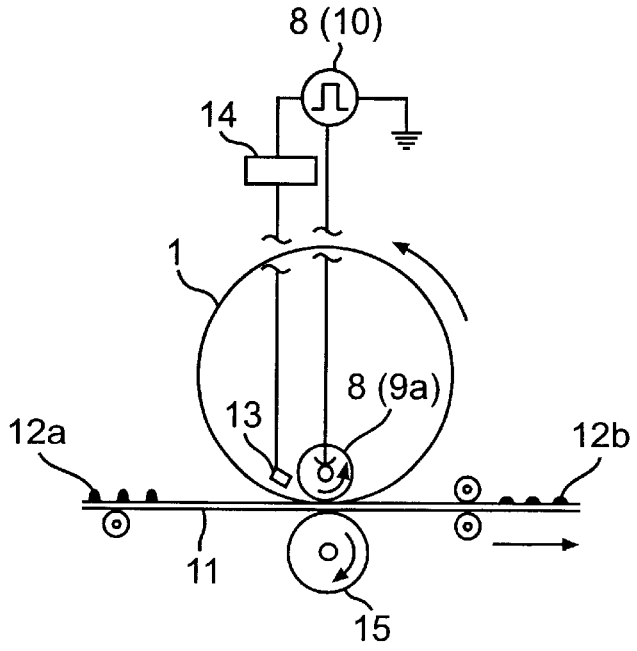
FIG. 5 is a schematic diagram showing another embodiment of a fixing apparatus using a tubular heat generating medium according to the present invention.

The heat generating medium 1 thus constructed is made in the form of an endless belt as shown in FIG. 4 or a tubular form as shown in FIG. 5.

In the present invention, a fixing apparatus, as shown in FIGS. 4 and 5, is composed mainly of the heat generating medium 1, and a power supplying means 8 for feeding electric power or current to the heat generating layer 4.

Figure 7:
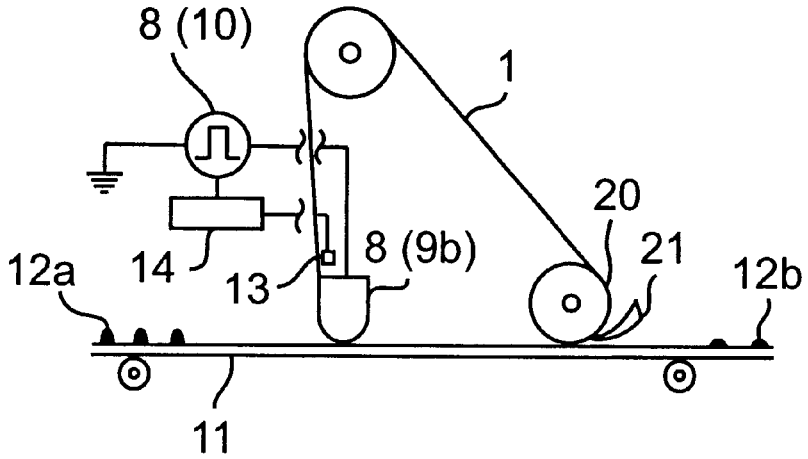
FIG. 7 is a schematic diagram showing still another embodiment of a fixing apparatus according to the present invention.
Figure 8:
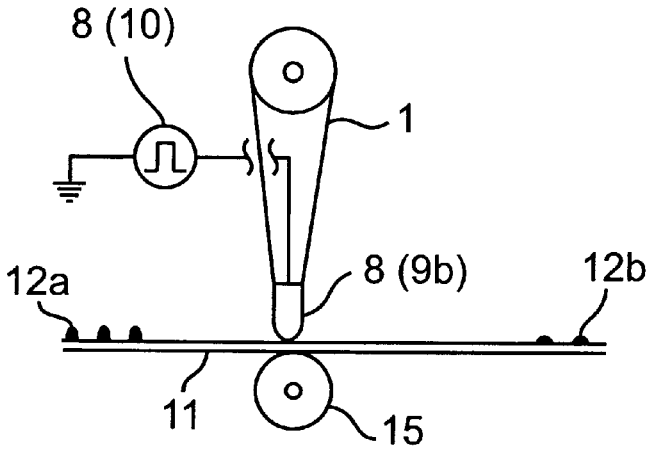
FIG. 8 is a schematic diagram showing a further embodiment of a fixing apparatus according to the present invention.
Figure 10:
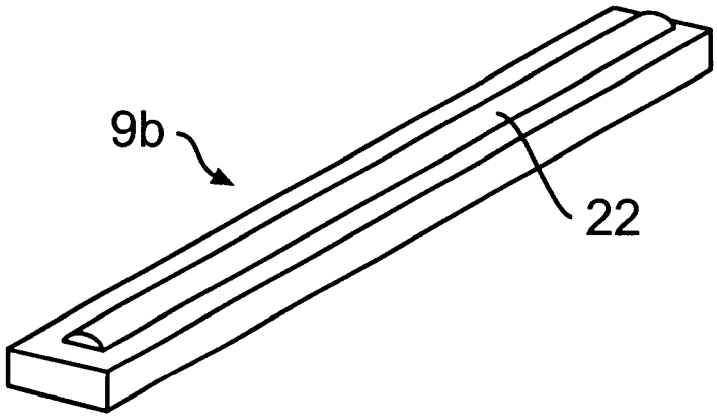
FIG. 10 is a perspective view showing a bar electrode used in a fixing apparatus.

The power supplying means 8 is basically constructed with a contact electrode 9 disposed in contact with the heat generating layer 4 of the heat generating medium, and a power source 10 for supplying pulse currents for temperature control to the electrode. The contact electrode 9 may be a roll electrode 9*a* dynamically contacting with the heat generating layer 4, or a bar electrode 9*b* statically contacting with the heat generating layer 4 as shown in FIG. 7 or 10. Use of the bar electrode 9*b* makes it easy to construct the fixing apparatus as shown in FIG. 7. In the figure, reference numeral 15 designates a press contact roll disposed in opposition to the contact electrode 9.

In the thus constructed fixing apparatus using the heat generating medium, the portions of the heat generating layer to which current is fed by the power supplying means 8 generate heat. In a process of fixing a non-fixed toner image 12*a* born by a recording sheet 11, only the portions receiving the current are heated. During the fixing process, the heat generating portion of the heat generating medium, viz., the heat generating layer, is disposed in extreme proximity of the non-fixed toner image, and the current-fed portions mainly generate heat to heat the non-fixed toner image. Therefore, the heat capacity of those portions is small and those portions quickly generate heat. As a result, the non-fixed toner image 12*a* is quickly heated to a high temperature. Because of the small heat capacity, the heat generating layer, after generating heat, quickly dissipates heat and temperature of the layer also quickly drops to approximately room temperature. In such a heat generating phenomenon, the total quantity of heat generating energy may be reduced, possibly reducing the temperature rise of the whole apparatus to a minimum. If required, the fixing apparatus of the invention may be equipped with a cooling means for checking temperature rise of the whole apparatus.

The apparatus of the present invention, as shown in FIGS. 4 and 5, includes a temperature sensing means 13 for sensing temperature of the heat generating layer 4 of the heat generating medium 1, and a power control means 14 for controlling electric power to the heat generating layer in accordance with temperature sensed by the temperature sensing means 13. With provision of the power control means operating in response to the output signal of the temperature sensing means, a quantity of heat generated in the heat generating medium 1 can be controlled, so that the fixed image is excellent.

Figure 6:
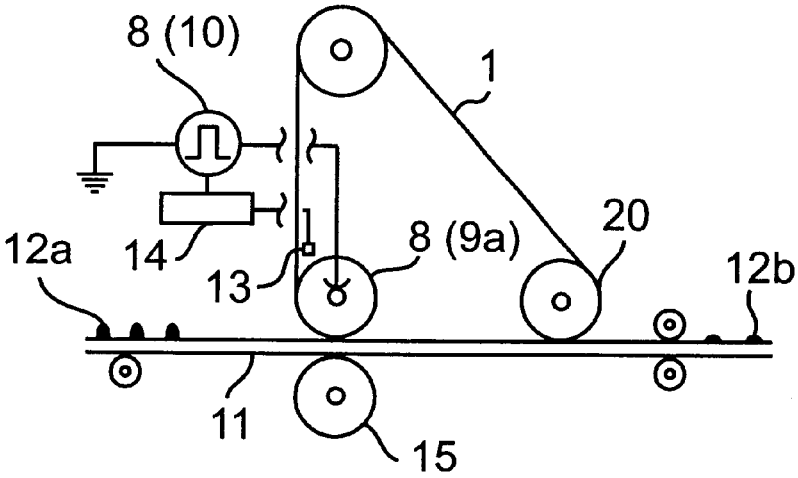
FIG. 6 is a schematic diagram showing yet another embodiment of a fixing apparatus according to the present invention.

In the apparatus of the invention, when the belt-like heat generating medium 1 is used, a portion between the contact electrode 9 of the power supplying means 8 and a pressure roll 15, as shown in FIG. 4, is used as a fixing portion and a peel-off portion. With this, a fixing process and a process for peeling a recording sheet from the heat generating medium 1 are carried out substantially concurrently. An alternative to the above is shown in FIGS. 6 and 7. In the alternative, the portion between the contact electrode 9 of the power supplying means 8 and a pressure roll 15 is used exclusively for a fixing portion A, and a peel-off portion B is provided separately from the fixing portion. The fixing process and the peel-off process are carried out at different times. In the construction where the fixing portion and the peel-off portion are separately provided, the fixed toner image can be sufficiently stuck to the recording sheet so as to eliminate an irregularity. The resultant fixed image is good. In FIGS. 6 5 and 7, reference numeral 20 designates a belt transfer roller constituting the peel-off portion B, and numeral 21, a peeling pawl.

Figure 11:
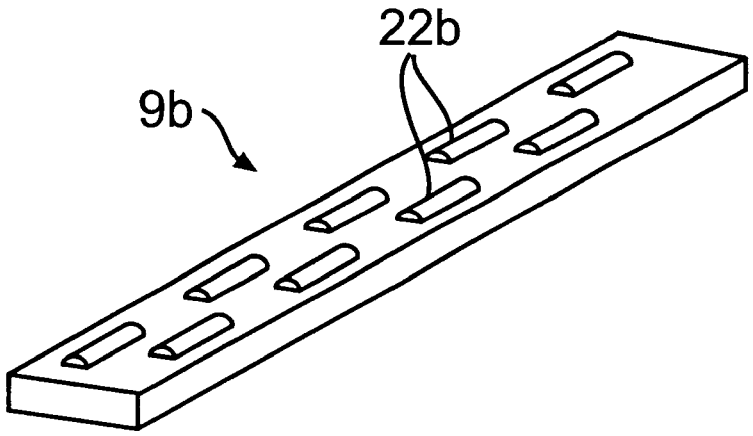
FIG. 11 is a perspective view showing another bar electrode used in a fixing apparatus.

In the apparatus of the invention, the roll- or bar-like contact electrode 9 in the power supplying means 8 may be constructed in the form of a divided electrode consisting of a plural number of contact electrode elements. In this case, current may be fed selectively to these contact electrode elements. As a result, heat is generated at the correspondingly selected portions of the heat generating medium. FIG. 3 shows an example of the divided roll electrode 9*a*, and FIG. 11 shows an example of the divided bar electrode 9*b*. The divided bar electrode 9*b* may be formed by dividing a continuous contact electrode 22 as of the bar electrode 9*b* shown in FIG. 10 into a plural number of contact electrodes (in the figure, reference numeral 22*b* designates divided contact electrodes).

Toner material (image forming material) applicable for the present invention may be any material for heat (pressure)

fixing, such us resin powder, sublimation material, liquid ink, and liquid dispersed particles In the present invention, the conductive support layer containing mainly metallic material has the support function in addition to the return electrode function. Accordingly, the whole heat generating medium also has a good tensile strength. When the heat generating medium is used for the fixing apparatus, its transport reliability is excellent.

In the heat generating medium, heat is generated mainly in the portions of the heat generating layer which are fed with current. The heat generating portions may be made to come nearer to the non-fixed toner image (approximately 10 μm to 1 mm). Accordingly, the thermal energy of the generated heat may be reduced to a minimum. As a result, a quantity of generated heat is reduced, and hence the power dissipation is correspondingly reduced. Since the heat generating layer is composed mainly of metallic material, it has a low specific heat and a high thermal conduction. Accordingly, it can transfer the heat generated by the heat generating layer to the fixing portion with little loss. Thus, the quantity of generated heat can be reduced, and the current-fed portions of the heat generating layer are caused to generate heat. Accordingly, temperature rise within the apparatus can be checked.

Since the portions of the heat generating layer where a fixing process is to be carried out are caused to generate heat, the total volume of the heat generating portions is small and the heat capacity is small. Therefore, temperature rise up to a required temperature can be achieved in a short time. In the fixing apparatus using the heat generating medium, time till the fixing temperature 1s reached is reduced.

Further, the low surface energy layer is layered on the surface of the heat generating medium, thereby preventing toner of the non-fixed toner image from sticking thereto. Since the heat capacity of the heating portion is small, the temperature control is easy in the fixing process, so that the resultant image is stable.

The present invention will be described in more detail using examples and comparisons.

EXAMPLE 1

The inner surface of a tubular support member 2 made of stainless (SUS304) and 20 μm thick and 100 mmΩ was coated with dispersed solution containing silicon resin and carbon black as major components by a dipping coating method. The conductive support member 2 was then dried for 20 minutes in an atmosphere at 150° C., and then sintered for 180 minutes in a nitrogen atmosphere at 400° C. Through the above process, a heat generating layer 4 of 5 μm thick and 4×10 Ω·cm in specific resistance was formed on the inner surface of the tubular support member 2. The outer surface of the tubular support member 2 was coated with liquid containing fine particles of Teflon dispersed therein, and sintered for 20 minutes in an atmosphere at 350° C. Through this process, a low surface energy layer 3 of 7 μm thick was uniformly formed on the outer surface of the tubular support member 2. A critical surface tension of the thus formed low surface energy layer 3 was measured by a Dethyman's plotting method. The result was 18 dyne/cm.

In this way, a sleeve-like heat generating medium 1 of the multilayer structure as shown in FIG. 1 was formed.

A fixing apparatus of the heat/pressure type was constructed using the thus formed sleeve-like heat generating medium 1, as shown in FIG. 5. As shown, a power supplying means 8 including a roll electrode 9*a*, which is made of copper and 10 mm in diameter, and a power source 10 for feeding a given DC current to the roll electrode 9*a*, was installed as shown. The roll electrode 9*a* was disposed in contact with the heat generating layer 4 layered on the inner surface of the heat generating medium 1 that is rotatable in the direction of an arrow. A pressure resilient roll 15 was disposed in opposition to the roll electrode 9*a*.

In the fixing apparatus, the roll electrode 9*a* was brought into contact with the pressure resilient roll 15 at linear pressure of 2 kg/cm, and these rolls were set to turn at linear speed of 50 mm/s.

A pulsative DC current fed from the power source 10 was specified as follows, pulse period was 2.5 ms; pulse width was 0.5 ms; and voltage was 20 V. The DC current was fed to the contact portion of the heat generating layer of the heat generating medium 1, through the roll electrode 9*a* and the conductive support member 2 as the return electrode. By the current, the portion of the heat generating medium 1 where it is in contact with the pressure resilient roll 15 was heated up to 160° C. A normal sheet 11 bearing a non-fixed toner image 12*a* was inserted into a nip between the roll electrode 9*a* and the pressure resilient roll 15 in a state that the non-fixed toner image 12*a* was in contact with the heat generating medium 1. Under this condition, the non-fixed toner image 12*a* was fused and fixed on the sheet.

As a result, a good fixed image where a fixed toner image 12*b* is stuck onto the recording sheet 11, was formed. A phenomenon that toner of the non-fixed toner image 12*a* sticks to the low surface energy layer 3 as the surface layer of the heat generating medium 1 was not observed. The fixed image was rubbed with an eraser 20 times repeatedly. As the result of the rubbing test, no deterioration of the image quality was observed. The power consumed for the heating in the fixing process was reduced by 30% when comparing with that of the heating roll fixing apparatus used in commercial copying machines.

COMPARISON 1

A heat generating medium 1 of COMPARISON 1 was the same as that of EXAMPLE 1 except that the low surface energy layer 3 is not used.

A critical surface energy of the surface of the sleeve-like heat generating medium 1 of which the support layer 2 is exposed to outside was 85 dyne/cm. A non-fixed toner image was fixed under the same conditions as that in EXAMPLE 1. Sticking of toner of the non-fixed toner image 12*a* onto the surface of the heat generating medium 1 was observed. The fixed image was bad.

EXAMPLE 2

A nickel seamless belt of 30 μm thick, formed by an electro-casting method, was used for the support member 2. The inner surface of the seamless belt was coated with a mixing liquid containing metal complex of ruthenium, metal complex of bismuth, and silicone resin. The resultant support member 2 was dried at 150° C. for 20 minutes, and sintered in a nitrogen atmosphere at 480° C. for 80 minutes. Through the process, a heat generating layer 4 of 1 μm thick and $3\times10^3$ Ω·cm in specific resistance was formed. The outer surface of the seamless belt was coated with liquid containing fine particles of Teflon dispersed therein, and sintered for 40 minutes in an atmosphere at 330° C. Through this process, a low surface energy layer 3 of 15 μm thick was uniformly formed on the outer surface of the seamless belt. A critical surface tension of the thus formed low surface energy layer 3 was measured by a Dethyman's plotting method. The result was 17 dyne/cm.

In this way, an endless belt-like heat generating medium 1 of the multilayer structure as shown in FIG. 1 was formed.

A fixing apparatus of the heat/pressure type was constructed using the thus formed endless belt-like heat generating medium 1, as shown in FIG. 4. As shown, a power supplying means 8 including a pipe-like roll electrode 9*a*, which is made of brass, and 10 mm in diameter and 4 mm thick, and a power source 10 for feeding a given DC current to the roll electrode 9*a*, was installed as shown. The roll electrode 9*a* was disposed in contact with the heat generating layer 4 layered on the inner surface of the heat generating medium 1 that is rotatable in the direction of an arrow. A pressure resilient roll 15 was disposed in opposition to the roll electrode 9*a*.

In the fixing apparatus, the roll electrode 9*a* was brought into contact with the pressure resilient roll 15 at linear pressure of 1.3 kg/cm, and these rolls were set to turn at linear speed of 100 mm/s.

A pulsative DC current fed from the power source 10 was specified as follows: pulse period was 1.0 ms; pulse width was 0.3 ms; and voltage was 12 V. The DC current was fed to the contact portion of the heat generating layer of the heat generating medium 1, through the roll electrode 9*a* and the conductive support member 2 as the return electrode. By the current, the portion of the heat generating medium 1 where it is in contact with the pressure resilient roll 15 was heated up to 140° C. A normal sheet 11 bearing a non-fixed toner image 12*a* was inserted into a nip between the roll electrode 9*a* and the pressure resilient roll 15 in a state that the non-fixed toner image 12*a* was in contact with the heat generating medium 1. Under this condition, the non-fixed toner image 12*a* was fused and fixed on the sheet.

As a result, a good fixed image where a fixed toner image 12*b* is stuck onto the recording sheet 11, was formed. A phenomenon that toner of the non-fixed toner image 12*a* sticks to the low surface energy layer 3 as the surface layer of the heat generating medium 1 was not observed. The fixed image was rubbed with an eraser 20 times repeatedly. As the result of the rubbing test, no deterioration of the image quality was observed. The fixing process was repeated 100,000 times. The resultant fixed image was rubbed with an eraser 20 times. No deterioration of the image quality was observed, and it was confirmed that a satisfactory fixing is possible.

EXAMPLE 3

Figure 9:
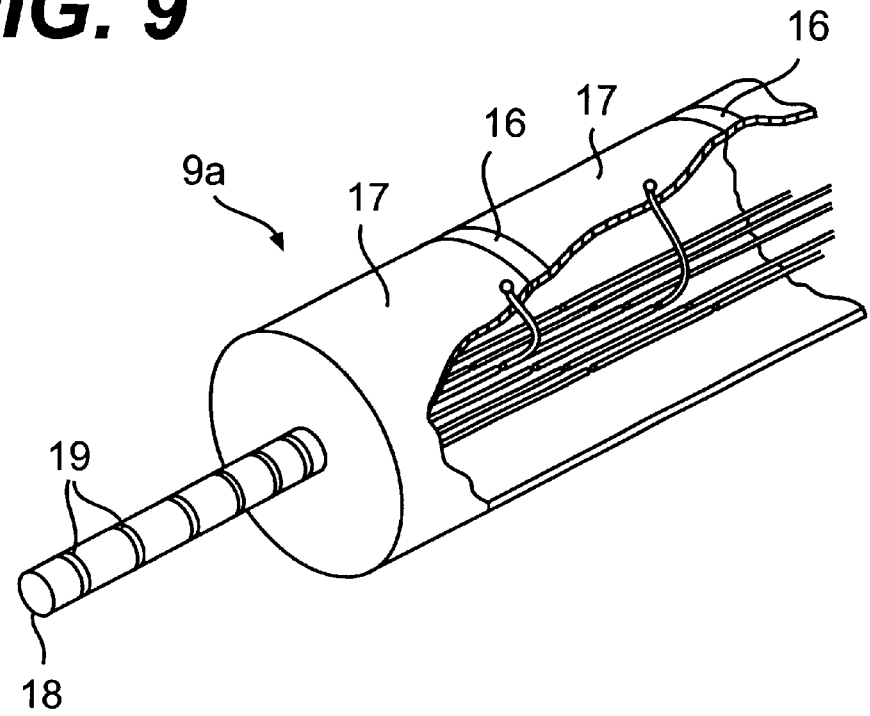
FIG. 9 is a perspective view, partly broken, showing a roll electrode used in a fixing apparatus.

In EXAMPLE 3, a heat generating medium 1 was constructed having the same structure as that in EXAMPLE 2 except that the pipe-like roll electrode 9*a* is a divided electrode. A fixing apparatus using the thus constructed heat generating medium 1 was also constructed. The pipe-like roll electrode 9*a* as the divided electrode, as shown in FIG. 9, is constructed such that insulating films 16 are longitudinally arrayed at intervals of 40 mm on a brass pipe member of 30 mm in diameter and 2 mm in thickness. Divided electrode surfaces 17 are respectively connected to address electrodes 19 formed on a rotary shaft 18 of the roll electrode by means of insulation covered wires. Those divided electrode surfaces receive current from the power source 10 through the address electrodes 19.

In the fixing apparatus, the pipe-like roll electrode 9*a* was brought into contact with the pressure resilient roll 15 at linear pressure of 1.6 kg/cm, and these rolls were set to turn at linear speed of 20 mm/s.

A pulsative DC current fed from the power source 10 was specified as follows: pulse period was 5.0 ms; pulse width was 4.0 ms; and voltage was 20 V. The DC current was fed to the contact portion of the heat generating layer of the heat generating medium 1, through the roll electrode 9*a* and the conductive support member 2 as the return electrode. By the current, the portion of the heat generating medium 1 where it is in contact with the pressure resilient roll 15 was heated up to 180° C. A non-fixed toner image was fixed as in EXAMPLE 2.

As a result, a good fixed image where a fixed toner image 12*b* is stuck onto the recording sheet 11, was formed. A phenomenon that toner of the non-fixed toner image 12*a* sticks to the low surface energy layer 3 as the surface layer of the heat generating medium 1 was not observed. The fixed image was rubbed with an eraser 20 times repeatedly. As the result of the rubbing test, no deterioration of the image quality was observed. Use of the pipe-like roll electrode as the divided electrode allows the heat generation portion to be divided. The power consumption was reduced when in EXAMPLE 2 (it was reduced to 80% of that of EXAMPLE 2.).

EXAMPLE 4

The inner surface of a nickel seamless belt 5 of 30 $\mu$m thick, formed by an electro-casting method, was electrolytically plated with gold, thereby forming a high conductive thin film 6 of 1.5 $\mu$m. The conductive support member 5 with the high conductive thin film layer 6 was used for the support member 2. The inner surface of the support member 2 was coated with a mixing liquid containing metal complex of ruthenium, metal complex of bismuth, and silicone resin. The resultant support member 2 was dried at 150° C. for 20 minutes, and sintered in a nitrogen atmosphere at 480° C. for 80 minutes. Through the process, a heat generating layer 4 of 1 $\mu$m thick and $3\times10^3$ $\Omega\cdot$cm in specific resistance was formed. The outer surface of the seamless belt was coated with liquid containing fine particles of Teflon dispersed therein, and sintered for 40 minutes in an atmosphere at 330° C. Through this process, a low surface energy layer 3 of 15 $\mu$m thick was formed on the outer surface of the seamless belt. A critical surface tension of the thus formed low surface energy layer 3 was measured by a Dethyman's plotting method. The result was 19 dyne/cm.

In this way, a belt-like heat generating medium 1 of the multilayer structure as shown an FIG. 2 was formed.

A fixing apparatus like that of EXAMPLE 2 was manufactured using the heat generating medium 1 as mentioned above.

A fixing process was carried out under the same conditions as in EXAMPLE 2, using the fixing apparatus. As a result, a good fixed image where a fixed toner image 12*b* is stuck onto the recording sheet 11, was formed. A phenomenon that toner of the non-fixed toner image 12*a* sticks to the low surface energy layer 3 as the surface layer of the heat generating medium 1 was not observed. The fixed image was rubbed with an eraser 20 times repeatedly. As the result of the rubbing test, no deterioration of the image quality was observed. The power consumed for the heating in the fixing process was reduced by 20% when comparing with that of the fixing apparatus of EXAMPLE 2.

EXAMPLE 5

The inner surface of a nickel seamless belt 1 of 25 $\mu$m thick, formed by an electro-casting method, was electrolytically plated with gold, thereby forming a high conductive thin film 6 of 1.5 $\mu$m. This gold plating layer was shaped into a pattern of stripes each of 1.5 mm wide that are arrayed at pitches of 2.0 mm in the width direction of the belt, by a photolithography method. In this way, stripe pattern electrodes 7 was formed. A heat generating layer similar to that in EXAMPLE 4 was formed on one of the surfaces of each pattern electrode 7, while a low surface energy layer 3 similar to that in EXAMPLE 4 was formed on the other surface thereof. A critical surface tension of the thus formed low surface energy layer 3 was 19 dyne/cm as in EXAMPLE 4.

In this way, a belt-like heat generating medium 1 of lo the multilayer structure as shown in FIG. 3 was formed.

A fixing apparatus like that of EXAMPLE 4 was manufactured using the heat generating medium 1 as mentioned above. Each pattern electrode was grounded by bringing a grounding conductive roll into contact with the exposed is conductive portion formed at the belt end portion.

A fixing process was carried out under the same conditions as in EXAMPLE 2 except: that the roll linear speed was 110 mm/s, using the fixing apparatus. As a result, a good fixed image where a fixed toner image 12*b* is stuck onto the recording shoat 11, was formed. A phenomenon that toner of the non-fixed toner image 12*a* sticks; to the low surface energy layer 3 au the surface layer of the heat generating medium 1 was not observed. The fixed image was rubbed with an eraser 20 times repeatedly. As the result of the rubbing test, no deterioration of the image quality was observed. The power consumed for the heating in the fixing process was reduced by A fixing apparatus, which is constructed using the heat generating medium, is very useful, while having the beneficial effects as just mentioned.

Having some specific embodiments of our bearing, it is believed obvious that modification and variation of our invention are possible in light of the above teachings. 13% when comparing with that of the fixing apparatus of EXAMPLE 4.

EXAMPLE 6

Temperature sensors 13 for sensing temperature were attached to a portion near the heat generating portion of the heat generating medium 1 of the fixing apparatuses of EXAMPLES 1 and 2. A power control circuit 14 for controlling an electric power supplied to the contact electrode 9 in accordance with temperature data fed back from each temperature sensor 15 was also provided. The fixing apparatus having the temperature sensor and the power control circuit was operated for fixing. It was confirmed that temperature within the apparatus was kept within a wide range of 5 to 45° C. The resultant printed image was rubbed with an eraser 20 times repeatedly. The image was excellent without any deterioration of the image quality.

As seen from the foregoing description, a heat generating medium of the invention is simple in construction, low in power consumption, and small in heat capacity. When it is assembled into a fixing apparatus, a required temperature for fixing can be reached quickly without increasing temperature within the apparatus. The temperature control is easy, and the transfer reliability is high

What is claimed is:

1. A heat generating medium for image fixing, comprising:

an electrically and thermally conductive support layer having a thickness of greater than or equal to 3 $\mu$m;

an adhesion prevention layer formed on a surface of said conductive support layer; and a heat generating layer having a thickness of less than or equal to 20 $\mu$m formed on another surface of said conductive support layer.

2. The heat generating medium for image fixing of claim 1, wherein said adhesion prevention layer has a heat resistance of not less than 130° C.

3. The heat generating medium for image fixing of claim 1, wherein said adhesion prevention layer has a critical surface tension not more than 32 dyne/cm.

4. The heat generating medium for image fixing of claim 1, wherein said adhesion prevention layer is made of material selected from the group consisting of fluorine plastics, fluorinated ethylene propylene (FEP), dimethyl polysiloxane resin, silicone rubber, or a composite material containing any of these materials and conductive powder.

5. The heat generating medium for image fixing of claim 1, wherein said adhesion prevention layer has a thickness of not more than 20 $\mu$m.

6. The heat generating medium for image fixing of claim 1, wherein said heat generating layer has a heat resistance of not less than 200° C.

7. The heat generating medium for image fixing of claim 1, wherein said heat generating layer has a volume resistance within a range from $10^{-3}$ to $10^{7}$ Ωcm.

8. The heat generating medium for image fixing of claim 1, wherein said heat generating layer is made of material selected from the group consisting of conductive ceramics, conductive carbon, and metal with one or more insulating materials.

9. The heat generating medium for image fixing of claim 1, wherein said conductive support layer has a thickness of 10 $\mu$m to 1 mm.

10. The heat generating medium of claim 1, wherein said conductive support layer is made of metallic material.

11. The heat generating medium of claim 1, wherein said conductive support layer has not more than $10^{-3}$ Ωcm of volume resistance.

12. The heat generating medium of claim 1, wherein said conductive support layer is made of material selected from the group consisting of nickel, SUS, aluminum, and copper.

13. The heat generating medium of claim 1, wherein said conductive support layer has not less than 10 kg/mm$^2$ of tensile strength.

14. The heat generating medium of claim 1, wherein said conductive support layer has not less than $6\times10^{-2}$ cal·cm$^{-1}$·sec$^{-1}$·deg$^{-1}$ of thermal conductivity.

15. The heat generating medium for image fixing of claim 10, wherein said metallic material is made of material selected from the group consisting of iron, copper, zinc, gold, silver, nickel, aluminum, titanium, cobalt, tungsten, molybdenum, stainless steel, alloys thereof.

16. The heat generating medium of claim 1, wherein said heat generating medium is an endless belt.

17. The heat generating medium for image fixing of claim 16, wherein said conductive support layer has a thickness of 3 to 200 $\mu$m.

18. The heat generating medium of claim 1, wherein said heat generating medium is tubular in shape.

19. A fixing apparatus comprising:

a heat generating medium for image fixing having an electrically and thermally conductive support layer having a thickness greater than or equal to 3 $\mu$m, an adhesion prevention layer formed on a surface of said conductive support layer, and a heat generating layer having a thickness less than or equal to 20 $\mu$m formed on another surface of said conductive support layer; and power supply means for supplying current to said heat generating layer, wherein a recording sheet bearing a non-fixed toner image thereon is brought into press contact with said heat generating medium which generates heat when it receives current from said power supply means.

20. The fixing apparatus of claim 19, further comprising:

temperature sensing means for sensing temperature of said heat generating medium; and power control circuit for controlling the supply of power to said heat generating layer in accordance with temperature sensed by said temperature sensing means.

* * * * *